United States Patent [19]

McGeary et al.

[11] 4,367,526

[45] Jan. 4, 1983

[54] GOLF CALCULATOR

[76] Inventors: Thomas C. McGeary, 2412 Palos Verdes Dr. W., Palos Verdes Estates, Calif. 90274; David J. McCarty, 4608 Cavendish Rd., Indianapolis, Ind. 46220

[21] Appl. No.: 184,821

[22] Filed: Sep. 8, 1980

[51] Int. Cl.[3] ..... G06F 15/44; G08B 5/36

[52] U.S. Cl. ..... 364/411; 235/92 GA; 340/323 R

[58] Field of Search ..... 364/410, 411, 412; 340/323 R; 235/92 GA; 273/1 E, 1 ES, 85 G, 87 R

[56] References Cited

U.S. PATENT DOCUMENTS

| | | | |
|---|---|---|---|
| 3,665,494 | 5/1972 | Baumoel | 235/92 GA X |
| 4,130,871 | 12/1978 | Olsen et al. | 364/411 |
| 4,142,236 | 2/1979 | Martz et al. | 364/411 |
| 4,266,214 | 5/1981 | Peters, Jr. | 340/323 R |
| 4,286,323 | 8/1981 | Meday | 364/411 |

*Primary Examiner*—Jerry Smith

*Attorney, Agent, or Firm*—Nilsson, Robbins, Dalgarn, Berliner, Carson & Wurst

[57] ABSTRACT

An electronic calculator is disclosed for use in golf play and includes a keyboard providing a number of keys or switches representative of digits and commands. A preprogrammed microprocessor functions in combination with the keyboard and memory means to store various data on players, courses, and contest arrangements for the players. Further manipulation of the keys provides commands to the microprocessor for performing predetermined computations on the data, and a display receives the results to indicate the scores and results of specified contests between individual players both during the game and at its conclusion.

5 Claims, 4 Drawing Figures

GOLF CALCULATOR

BACKGROUND AND SUMMARY OF THE INVENTION

The game of golf is extremely popular throughout the world and is widely played both as a serious athletic endeavor and as a basis primarily for social relationship. Inherently, the game involves self competition wherein the player strives to improve on his anticipated score. In that regard, regular players usually have assigned handicaps based upon their prior play and particularly their most recent scores. Accordingly, in a typical round of golf, a player seeks to score better than would be indicated by his present handicap.

As golf provides a basis for individual competition, relative equality between a group of players is not necessary for a compatible relationship. That is, a foursome of golfers may well have a pleasant and enjoyable game together even though their individual capabilities vary considerably. In spite of the self-competition aspect of golf, the game is frequently enhanced by contest arrangements that normally reflect individual capability or handicap. For example, in the most simple situation, two players might simply compete on the basis of their individual handicaps. Essentially, the contest would reflect a competition between the golfers, each pitted against the other, on the basis of their individual capability, as manifest by their handicaps. Apart from such a direct competitive arrangement, a number of competitive relationships for enhancing the game of golf are widely used and well defined. Such arrangements include team play, nassau arrangements, and press arrangements.

The standard golf course consists of eighteen holes each of which involves the contest of stroking a ball into a cup with the minimum number of strokes. On a given course, each hole is assigned a numerical value, i.e. par, which represents the number of strokes allotted to an expert. Accordingly, the par value is an indicator of the difficulty in playing the hole, i.e. the higher the par value, the more difficult the hole.

Individual players are assigned handicaps based on their individual performance in relation to par. For example, a player might have a handicap of eleven, indicating that on the basis of his recent scores, he is expected to score eleven strokes over par. Generally, as indicated above, arranged contests between players are based upon a consideration of player handicaps. For example, if a player having a handicap of eleven strokes entered a contest with a player having a handicap of fifteen strokes, normally the poorer player would expect to enjoy a four-stroke advantage in the scoring. Regarding the application of such strokes, as the play progresses, they are traditionally allotted or assigned to the holes of greatest difficulty.

Score counting, with the allocation of handicap strokes may become rather complex. The scoring in contests is sometimes further complicated by so-called "press" arrangements which are initialed after play has begun. As a consequence of the various competitive combinations which might be arranged within a group of players, and those which may develop during the course of play, the computations and scoring may become quite complex. The use of the present invention tends to minimize the time and effort which is otherwise required for score keeping and computations to maintain a record and provide the status of various individual contests.

It is recognized that various computer systems previously have been proposed for providing the consequences of different forms of competitive play. For example, U.S. Pat. No. 3,974,483 (Brunson) discloses a system for computing bowling scores. U.S. Pat. No. 4,031,376 (Corkin) discloses a system for use in the sport of horse racing which is embodied in a small hand-held calculator. Similar forms of structures have been proposed for bridge scoring, as in U.S. Pat. No. 4,130,871 (Olson) and golf scoring as in U.S. Pat. No. 4,142,236 (Martz). However, a need continues for such a convenient form of calculator which incorporates structure not only for providing a golf score but furthermore for calculating and providing the resulsts of various competitive arrangements as specified between individual players of a group. The calculator of the present invention fulfills such a need by utilizing a preprogrammed microprocessor which receives data from a keyboard and stores it in a memory for subsequent retrieval and use. The elements of the system are coupled for operation through the processor which controls the flow of data and commands to accomplish specified manipulations and drive the display. More specifically, the product of the present invention is a special-purpose, hand-held calculator, which incorporates a keyboard, a digital display, electronics, and battery power means integrated with a microprocessor and semiconductor memory which enable the product to be programmed to accomplish the results of commanded instructions specifying golfing data and competitive golf relationships.

BRIEF DESCRIPTION OF THE DRAWINGS

In the drawings, which constitute a part of this specification, an exemplary embodiment, demonstrating the various objectives and features hereof, is set forth as follows.

DESCRIPTION OF THE ILLUSTRATIVE EMBODIMENT

As indicated above, a detailed illustrative embodiment of the invention is disclosed herein. However, systems for computing the results of contest arrangements between individual golfers may be embodied in accordance with various forms, some of which may be detailed rather differently from the disclosed embodiment. Consequently, the specific structural and functional details disclosed herein are merely representative, yet in that regard they are deemed to afford the best embodiment for purposes of disclosure and to provide a basis for the claims herein which define the scope of the present invention.

Figure 1:
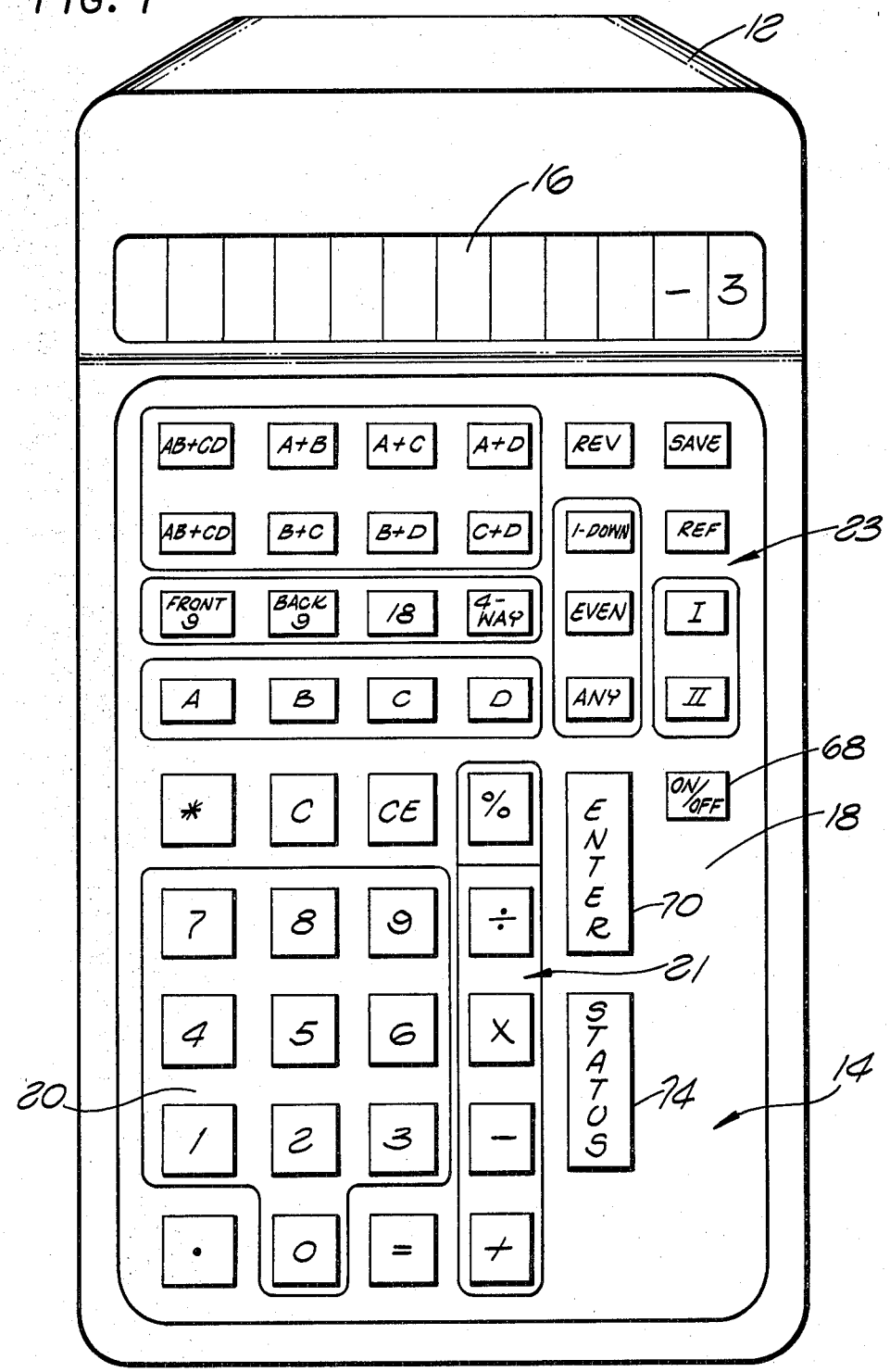
FIG. 1 is a perspective view of a calculator for golf constructed in accordance with the present invention.

Referring initially to FIG. 1, a calculating system constructed in accordance with the present invention is illustrated in a disclosed embodiment. Generally, the system provides a conventional five-function calculator capability in addition to affording the programmed special-purpose computer operations applicable for use in the game of golf. Specifically, in a golfing context, the system receives preliminary instructions or commands along with course and handicap data; then as the play progresses, individual scores are entered with the result that the device computes the results for any of a variety of competitive golfing arrangements. In that regard, the disclosed system accommodates competitive arrangement scoring for up to four players.

The disclosed embodiment of the system as illustrated in FIG. 1 is approximately seven inches high, four inches wide, and one and one-half inches thick. Essentially, such dimensions specify the housing 12 of a somewhat parallelepiped configuration, the upper panel 14 of which incorporates a digital display 16 and a keyboard 18. In the disclosed embodiment, the display 16 provides a multiple-digit illuminated display using seven-segment type numerals. Of course, such displays and energizing apparatus for them are well known and widely used in hand-held calculators of the prior art.

Considering the elements of the keyboard 18 somewhat generally, keys for the digits zero through nine are provided in a numeric section 20. These keys are used both in the golf computer function and to perform routine arithmetic calculations.

Positioned generally around the numeric section 20 are a number of control keys, some of which are also multiple function, the labels and individual functions of which are considered in greater detail below.

Above the numeric section 20 are several other keys 23 generally dedicated to providing command functions to accomplish competitive golfing arrangements. These keys also will be considered in greater detail below.

Recapitulating to some extent, the keys in the numeric section 20 along with the contiguous command keys 21 may be utilized to perform conventional five-function calculator capability. However, specific to the present invention of a golf calculator, most of the keys in section 20 and keys 21 are useful in cooperation with the command keys 23 on the panel 14 to input golfing data and golfing commands as well as to command status displays. Essentially, the operation of the system in a golfing context involves three distinct functional phases. Detailed descriptions of the operating phases are provided below; however, preliminarily each phase of operation relates to a phase of play. First, the preparatory operations are performed, when the system is provided with certain basic data, i.e. handicap information, course information, competitive player combinations, and any special instructions. The second phase of operation is coincident with the progress of actual play and involves inputting the scoring data as it develops. It is noteworthy that the system may also receive commands to define enhanced competitive relationships between players after play has begun. The third operational aspect of the system involves the output of competitive results. The status of play may be provided during the course of play and final results are provided when play is concluded.

Figure 2:
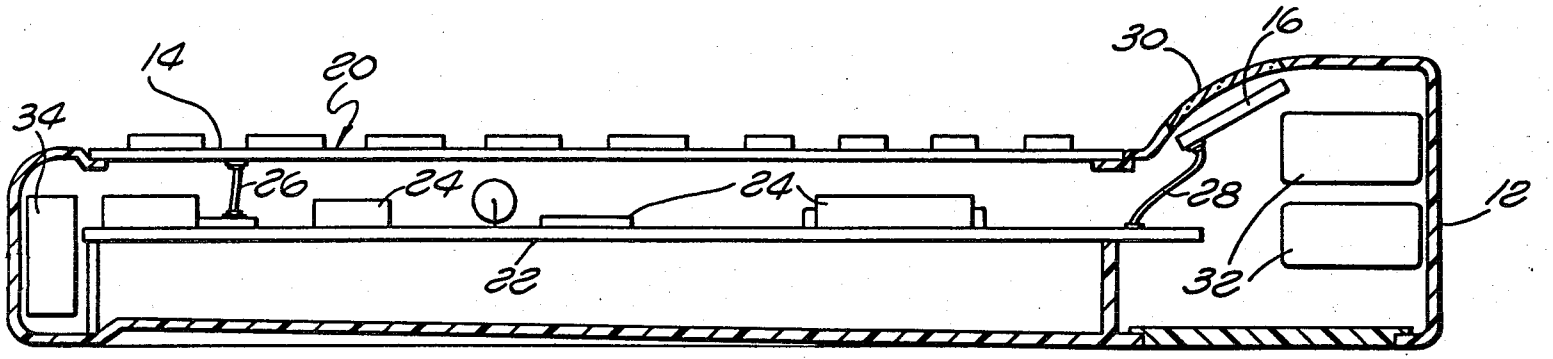
FIG. 2 is a sectional view and component diagram illustrating the individual components in the apparatus of FIG. 1 and the relationship between such components.

Considering the structure of the device in somewhat greater detail, reference will now be made to FIG. 2 which is generally a vertical sectional view taken centrally through the device as illustrated in FIG. 1. Representative keys on the panel 14 are indicated, below which the major electrical components are mounted. In that regard, a printed circuit board 22 is suspended for firm support within the housing 12. The board 22 carries certain coupling and driver electronics along with a microprocessor, ROM and RAM memories, and a serial shift register, all of which elements 24 are generally designated on the printed circuit board 22. The elements 24 are connected to individual key contacts (not shown) on the panel 14 through a wire bundle 26 and to contacts (not shown) for the display 16 through a wire bundle 28. Note that a lens 30 is affixed in the housing 12 over the digital display 16. A pair of batteries 32 are also mounted within the housing 12 and connected to the elements 24 although such connections are not illustrated in FIG. 2. Of course, interconnection between individual terminals of the electrical elements 24 is provided by conductive paths on the printed circuit board 22 as well known in the art. Finally, as also well known in the art, a power supply apparatus 34 is provided in the disclosed embodiment whereby the system may be powered from an alternating current source, as to conserve and/or charge the batteries 32 as well known in prior portable electronic units.

Considering the electrical elements 24 in somewhat greater detail, reference will now be made to FIG. 3 in which both changeable and fixed memory elements are illustrated. That is, more specifically, the changeable memory elements take the form of semiconductor random access memories, RAM units, while the fixed memory elements comprise semiconductor read-only memory elements ROM units. In general, the ROM memory is used to contain instructions and programs while the RAM memory is employed for operational and working data. Of course, movement and processing of instructions as well as data is controlled and accomplished by a microprocessor, as disclosed in greater detail below.

Figure 3:
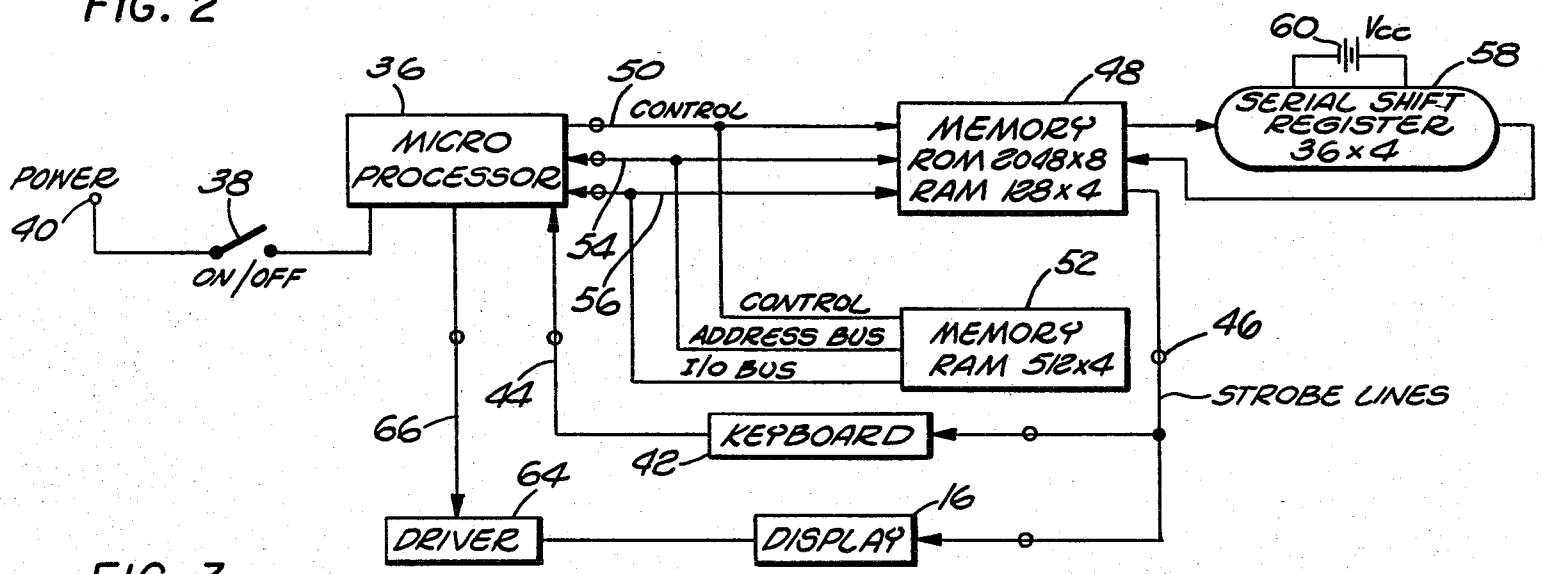
FIG. 3 is a block diagram illustrating the components of the apparatus of FIG. 1 and the data flow therebetween.

As illustrated in FIG. 3, control of the system is accomplished by a microprocessor 36 (upper left). The microprocessor may take the form of a unit manufactured by the Intel Corporation of Santa Clara, Calif., which is readily available on the market. The microprocessor 36 is variously connected to the other operating elements of the system. In that regard, operating power is supplied to the processor 36 through an "on-off" switch 38. As illustrated, power is supplied through the switch 38 from a terminal 40. A control for the microprocessor, as explained below, places the system in a low-power state wherein only a few critical circuits are operative.

The microprocessor 36 is connected to all the keys on the panel 14 (FIG. 1) collectively considered as a keyboard 42 through a multiple conductor 44 (FIG. 3). Specifically, the keyboard 42 provides a digital signal representation of characters in a four-bit format as well known in the prior art. Such representations are controlled by strobe lines 46 which carry signals from a memory 48 and which are also supplied to the display 16 as illustrated in FIG. 3.

The memory 48 incorporates both ROM and RAM capacity and in that regard may be as manufactured by the Intel Corporation of Santa Clara, Calif. The memory 48 is connected to the microprocessor 36 through several signal paths. Specifically, a set 50 of three conductors couple the microprocessor 36 to the memory 48 as well as to a RAM unit 52. A twelve-conductor address bus makes a similar connection as does an input-output bus 56 of eight conductors.

The memory 48 is supplemented by a shift register 58 with an independent power supply in the form of a battery 60. The register 58 is simply connected in a loop from the memory 48 and serves to register generally static information, i.e. data on the player's home course. The battery 60 constantly supplies power to the register 58 so that the combination retains the registered data.

The display 16 is connected to be energized by an eight-segment driver 64 which is in turn connected through a four-conductor line 66 to the microprocessor 36. Accordingly, data from the microprocessor 36 is provided through the line 66 to the driver 64 for selectively actuating the display 16 in a sequence controlled by signals carried in the strobe lines 46. Upon the actuation of a key in the keyboard 42, signals are formed representative of either a numeric (data) or a control function or instruction. If a numeric key is actuated, signals supplied through the wires 44 to the microprocessor 36 are transferred to the memory 48 for subsequent use. Conversely, if the key actuated on the keyboard 42 produces signals representative of a control function, then the microprocessor 36 interprets the instruction or command either singly (depending on the character) or with others in a composite transaction and actuates the system to accomplish the specified operation. Of course, as well known in the operation of microprocessors, specific actions are simply a function of programmed instructions that have been designed into the system along with the primary memory 48.

In view of the above description of the structure and form of the disclosed embodiment, a comprehensive understanding thereof may now be best accomplished by assuming certain operating conditions and pursuing an explanation of the events that occur during different phases of operation. However, preliminarily, some further details will be provided on the form of computations and competitive relationship accomodated by the disclosed embodiment.

The apparatus of the preferred embodiment is to be used on a golf course having a par rating whereby each hole is rated in order of difficulty by the number of strokes allowed to achieve a so-called "par" score. Furthermore, the players each have assigned handicap scores based upon their performance in recent games, playing certified courses. Generally, as indicated above, the handicap of a player is the measure of the additional (or fewer) strokes that the player averages for eighteen holes of play in relation to the course rating of par. For example, a player having a handicap of ten is rated and expected to score ten strokes above par in a given round of golf.

Concerning contest arrangements between players, a number of standard possibilities exist. One arrangement which is widely used and is accommodated by the disclosed embodiment is sometimes referred to as nassau play. Such an arrangement is based upon eighteen holes of play and the scoring is applicable to sets of nine holes. For example, one point is awarded to the winner of the first nine holes of play; one point is awarded to the winner of the second none holes of play; and one point is awarded to the total eighteen holes of play. Of course, nassau arrangements may be made between two players of a foursome or two teams of a foursome. As one variation of team play, the contest might involve counting only one player's source for each hole of play. That is, for example, only the best score (sometimes called the "best ball") for a hole of play by the team is tallied as the score. Of course, various other arrangements can be facilitated including a so-called "worst ball" program.

Another form of popular contest between players is sometimes called a "press" arrangement. Press arrangements are based on the remaining play from any specific point of play. Accordingly, press arrangements may be entered before actual play is begun or they may be initiated at the conclusion of any specific hole. Essentially, such arrangements place players in contest, based upon their existing handicaps and the ratings of the golf course, for the remaining holes of play in a game. It is to be noted, that in accordance with general custom, the allocations of handicap strokes are applied to holes on the basis of the rated difficulty of the holes.

In view of the above considerations, it is apparent that the computations attendant various golf arrangements may become rather laborious, particularly if several contests are arranged between individual players as well as teams of players. With such a general background in mind, exemplary use of the apparatus of the disclosed embodiment will now be pursued in some detail.

The preliminary operating phase of the system involves initializing manipulations. This operation involves inputting data to the system on the players, the golf course, and initial contest arrangements. Of course, input involves using the keyboard 42 (FIG. 3) to formulate all data and command operations. In accordance with conventional operating formats, numeric information is displayed by the digital display 16 simultaneously with entry.

The first step in initiating operation is to depress the "on/off" key 68 (FIG. 1) which closes the switch 38 (FIG. 3) to energize the electronic elements 24. Note in that regard, that as explained above, prior to closure of the switch 38, the register 58 was energized by the battery 60 (the combination involving exceedingly low power) so that the contents of the register 58 is normally preserved from one use of the apparatus to another. However, to load the register 58, either initially or in the event of a change, the "ENTER" key 70 (FIG. 1) is first depressed to start an input sequence. The data is supplied then is designated as the data for a home course (which is to be placed in the register 58) by depressing the key labeled "%", one of the command keys 21. As a result of these operations, binary signals ST and HC are formed in a high state to indicate that the home course data will follow. Note that a list of signals with sources and functions is set forth below as a convenient reference and summary.

| Signal | Source | Function |
|---|---|---|
| ST | "ENTER" key | designates input operation |
| HC | "%" key | designates home course data, hole-by-hole |
| EN | "ENTER" key | designates end of input operation |
| HD | processor and numeric keys | data on home course |
| VC | "*" key | designates visiting course data, hole-by-hole |
| VD | processor and numeric keys | data on visitor course |
| AP | "A" key | designates A player |
| BP | "B" key | designates B player |
| CP | "C" key | designates C player |
| DP | "D" key | designates D player |
| AH | processor and numeric keys | player A handicap data |
| BH | processor and numeric keys | player B handicap data |
| CH | processor and numeric keys | player C handicap data |

-continued

| Signal | Source | Function |
|---|---|---|
| DH | processor and numeric keys | player D handicap data |
| BB | key: "AB + CD(bb)" | commands contest between AB and CD based on best ball play |
| BW | key: "AB + CD(wb)" | commands contest between AB and CD based on worst ball play |
| AB | key: "A + B" | commands contest between A and B |
| AC | key: "A + C" | commands contest between A and C |
| AD | key: "A + D" | commands contest between A and D |
| BC | key: "B + C" | commands contest between B and C |
| BD | key: "B + D" | commands contest between B and D |
| CD | key: "C + D" | commands contest between C and D |
| RE | key: "REV" | commands reversal of commanded contest |
| DO | key: "1-DOWN" | adjusts press contest downward |
| EV | key: "EVEN" | sets press contest even |
| AN | key: "ANY" | sets press contest |
| FN | key: "FRONT 9" | sets nassau contest |
| BN | key: "BACK 9" | sets nassau contest |
| EI | key: "EIGHTEEN" | sets nassau contest |
| FW | key: "4-WAY" | sets nassau contest |

After the preliminary operations indicated above to designate home-course data as the next input, the numeric section 20 (FIG. 1) is utilized to enter the first hole rating, e.g. the value of five, to indicate five strokes for the first hole. Thereafter, the key designated "%" is again depressed and the numeric section 20 is again utilized to indicate the rating for the second hole. That pattern is repeated to register the hole ratings for each of eighteen holes.

Figure 4:
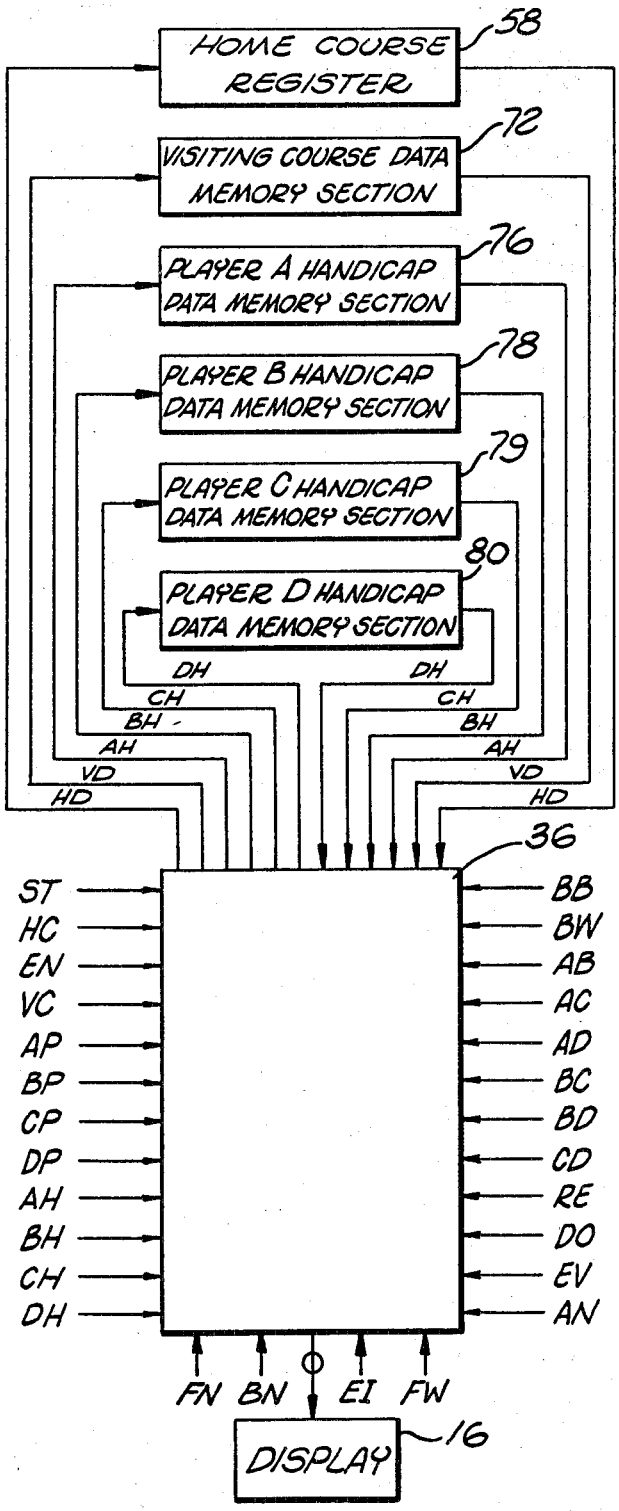
FIG. 4 is a block diagram illustrating data flow and manipulation.

At the conclusion of the home-course data operation, the key "ENTER" is again depressed to formulate a signal EN indicating the conclusion of an input operation. In that manner, the home-course data HD is received and provided from the processor 36 (FIG. 4) to the register 58.

To accommodate play at a visiting course, the data on such course is to be freshly entered. Specifically, after depressing the "ENTER" key 70, data is designated as visiting-course data VD by depressing the key determined by an "*" which forms a signal VC. Just as for the entry of the home course data, visiting-course data VD is entered hole-by-hole following each depression of the "*" key. At the conclusion of the operation, the "ENTER" key is again depressed to terminate the input operation with the consequence that the visiting course data VD is registered in a memory section 72 (FIG. 4) of the memory 48.

The next step in the initializing process involves entering the handicap data for each of the four players. Again, the "ENTER" key 70 is depressed followed by selective depression of the player designation keys A, B, C, and D and the appropriate handicap data. Normally, the handicap data will be entered in the alphabetic order of letters assigned to the individual players. That is, usually the player key "A" will be depressed followed by depression of numeric keys in the section 20 to indicate the handicap forming a signal AH for the player who is identified by the letter A. Following the entry of data on player A, the data on players B, C, and D is similarly entered by depressing the player keys "B", "C", and "D", followed by the numerics to indicate their handicaps to form the signals BH, CH, and DH. Again, at the conclusion of this operation, the "ENTER" key is depressed to conclude the input operation. Thereafter, the player handicap data (signals AH, BH, CH, and DH) is respectively registered in the data memory sections 76, 78, 79, and 80. At the conclusion of these preliminary operations, the system is operated to input the various competitive arrangements as the so-called nassau arrangement.

A number of keys on the keyboard 18 (FIG. 1) facilitate various specific nassau arrangements. However, initially consider the operations for setting up a basic nassau arrangement. As in the example considered above, the initial operation involves depressing the "ENTER" key 70 (FIG. 1) to initiate an input interval. Next, keys are depressed to indicate the predetermined player contests. Specifically, as indicated in the above chart, any of the keys designated as: AB & CD (with best or worst ball); A & B; A & C; A & D; B & C; B & D; and/or C & D may be depressed as commands of gaming formats, that is, to command contests between players designated by the letters which will be scored by the system.

After the selection of the contest-arranging keys, the system will interpret the nassau as a so-called three-way arrangement unless the key designated "4-WAY" is depressed. Note that the other keys aligned with the key designated "4-WAY" are used in commanding status information. As a part of a nassau arrangement, press arrangements may also be included. In such an event, any one of the keys designated: "1-DOWN", "EVEN", or "ANY" may be used to specify specific press arrangements. Also, a pair of keys designated by Roman Numerals "I" and "II" may be employed to specify other than standard handicap criteria.

At the conclusion of entering data to command detailed aspects of each contest, another nassau arrangement key may be depressed. Note that these include the team play nassaus as well as all possibilities for individual play combination.

Each of the keys as considered above provides the formulation of a signal as specified in the above chart. These signals are applied to the processor 36 (FIG. 4) to initiate instructions for predetermined computation patterns of scoring the selected contest arrangements. Of course, the instructions may be variously registered or set in command within the processor 36 or use the memory availability of the memories 48 or 52. With the complete specification of the contest arrangements, the "ENTER" key 70 is again depressed to indicate the conclusion of the input interval. Thus, the system is prepared to receive golfing scores on a hole-by-hole basis and provide the scoring results from the various preselected contest arrangements. After the initializing operations as described above, the apparatus of the disclosed embodiment may be conveniently and effectively used during the course of play to indicate the status of the various contest arrangements as well as to initiate further contest arrangements. Specifically, after each player completes the first hole of golf, the scores are entered in the apparatus. Specifically, the "ENTER" key 70 (FIG. 1) is depressed followed by the actuation of keys in the numeric section 20 to designate the hole number. Next, a player key is selected, e.g. the key designated "A", and the actual stroke count for that player is entered on a selected key or keys in the numeric section 20. That operation is repeated for each of the players in the contest group. At the conclusion of the input operations, the "ENTER" key 70 is again depressed as repeatedly explained above.

As play continues and scores are entered, press arrangements can be started on any of the remaining holes of play. These arrangements are independent of the press arrangements previously commanded to the apparatus. Specifically, such arrangements are commanded by depressing the "ENTER" key 70, followed by a designation of the next hole number, using the numeric section 20. The player combination must be again specified in terms of the labels A, B, C, or D using the appropriate keys. As indicated above, the order between selected players in contest may be reversed by depressing the key designated "REV". If a nassau arrangement is to be assigned, the desired key is depressed after which the transaction is concluded by again depressing the key 70.

Throughout the interval of play, at the conclusion of play, the players can obtain the status of the scoring in various contest arrangements by interrogating the apparatus. Of course, the processor 36 simply computes the various contest arrangements using established formulas or manipulation to attain the results. For example, in a nassau arrangement between players A and B, the status, for example, after a given hole would be indicated by allotting the player's handicap to the holes played and appropriately subtracting strokes from his score as appropriate. The differences between the two results of such computation for the individual players would then indicate the status of play at that time. Of course, such computations are well known and variously applied in accordance with established standards and customs to score various competitive arrangements.

Output operations indicative of status are accomplished by using a status key 74 (FIG. 1). For example, if the status of an arranged contest between players A and B is desired, the status key 74 is depressed followed by depression of the key designated "A & B". As a consequence, the computation is performed in the processor 36 (FIG. 4) and drive signals are supplied to the display 16 (FIGS. 1 and 4) where the status is indicated. Of course, the apparatus may also be used to indicate the individual scores of players, and as explained above, the apparatus may be operated as a five-function calculator.

In summary, the disclosed embodiment is effective not only for general calculations, but more to the point of the present invention, to record the criteria which is used in calculating the status of competitive arrangements and also to record the results of the game and display such results in the form of precise information on any of a wide variety of competitive arrangements.

It is to be noted, that certain of the keys in the keyboard 18 have specialized functions which have not been treated in detail herein. In that regard, such keys may be used for operations which are not significant to the present invention. Of course, certain keys also have dual functions as in the case of the "%" key which is used both as a code in golf transactions and in its normal function for the calculator. Other keys are not used in the golfing application. Specifically, neither the decimal point "." key nor the equals sign "=" key are used in golfing applications. The clear entry key CE and the clear key C have their conventional function both in golfing and computing operations.

The key designated "SAVE" extinguishes power for the display 16 (FIG. 3) and certain other selective circuits which results in conservation of energy. Normally, the key designated "SAVE" will be depressed in actually beginning the play for a hole of golf. At the conclusion of the hole, the key designated "REF" (refresh) will be actuated to fully re-energize the system.

In summary, it may be seen that an apparatus of the present invention as described with respect to a disclosed embodiment, affords a convenient and practical system for recording and calculating the consequences of the game of golf. Of course, the system may be variously implemented in forms substantially different from the disclosed embodiment, particularly in view of the continuing development of RAMs, ROMs, and microprocessors. Consequently, the scope hereof is deemed to be as set forth in the claims as follows.

What is claimed is:

1. An electronic calculator for use by a plurality of individual players in the game of golf, comprising a relatively small housing, sized to be hand held:

keyboard input means in said housing, including switches representative of digits and instructions for selectively inputting numerical golf course data and player scoring data for the plurality of individual players, and further including a plurality of switches for designating various competitive relationships to be scored between specific ones of said plurality of individual players;

processing and memory means responsive to the keyboard input means for receiving said data, and for performing predetermined automatic operations on said data as specified by said commands to provide computed data representative of specific combinations and variations of said data and including scores computed for said various competitive relationships as selected on said keyboard input means; and output means responsive to the processing and memory means for visually representing selective computed data under control of said keyboard.

2. An electronic calculator according to claim 1 wherein the keyboard input means is operable to input individual player stroke counts for each hole of a game of golf as play ensues.

3. An electronic calculator according to claim 1 wherein said keyboard means includes means to designate a specific portion of a golf course for play.

4. An electronic calculator according to claim 1 comprising a microprocessor, ROM and RAM memory means.

5. An electronic calculator according to claim 1 further including a shift register means and an associated separate battery, for registering relatively fixed home-course data.

* * * * *